US007134800B2

(12) United States Patent
Kaneda

(10) Patent No.: US 7,134,800 B2
(45) Date of Patent: Nov. 14, 2006

(54) LOOSE-LEAF BINDER WITH LOCK

(75) Inventor: Koji Kaneda, Yokohama (JP)

(73) Assignee: Kokki Kaneda, Tokyo (JP)

( * ) Notice: Subject to any disclaimer, the term of this patent is extended or adjusted under 35 U.S.C. 154(b) by 448 days.

(21) Appl. No.: 10/803,423

(22) Filed: Mar. 18, 2004

(65) Prior Publication Data

US 2005/0105958 A1 May 19, 2005

(30) Foreign Application Priority Data

Nov. 18, 2003 (JP) ..... 2003-387673

(51) Int. Cl.
*B42F 13/26* (2006.01)

(52) U.S. Cl. ..... 402/38; 402/41

(58) Field of Classification Search ..... 402/2, 402/19–20, 26, 31, 37–39, 41, 70, 501, 502; *B42F 13/26*
See application file for complete search history.

(56) References Cited

U.S. PATENT DOCUMENTS

| | | | | |
|---|---|---|---|---|
| 1,800,268 | A * | 4/1931 | Trussell | 402/38 |
| 2,183,231 | A | 12/1939 | Trussell | 129/24 |
| 2,381,040 | A * | 8/1945 | Dawson et al. | 402/39 |
| 2,871,863 | A * | 2/1959 | Segal | 402/38 |
| 3,135,266 | A * | 6/1964 | Bouhier | 402/38 |
| 3,205,894 | A | 9/1965 | Rankin | 129/17 |
| 3,205,896 | A * | 9/1965 | Weichert | 402/38 |
| 3,253,603 | A * | 5/1966 | Levitan | 402/38 |
| 3,348,550 | A | 10/1967 | Wolf et al. | 129/24 |
| 3,827,111 | A | 8/1974 | O'Connell | 24/230 CF |
| 5,346,325 | A * | 9/1994 | Yamanoi | 402/38 |

FOREIGN PATENT DOCUMENTS

| | | | |
|---|---|---|---|
| JP | 5-88680 | | 12/1993 |
| JP | 2000118182 | A * | 4/2000 |
| JP | 2000211282 | A * | 8/2000 |

OTHER PUBLICATIONS

Search Report in EPO 04 29 1884 dated Mar. 14, 2005.

* cited by examiner

*Primary Examiner*—Monica Carter
*Assistant Examiner*—J Williams
(74) *Attorney, Agent, or Firm*—Marshall, Gerstein & Borun LLP

(57) ABSTRACT

A locking member for a loose-leaf binder includes a member having an integrally pivoted portion pivotally mounted in a first actuating member, an engaging projection which engages with an engaging recess of a second actuating member to prevent movement of the second actuating member. An elastic portion which abuts against an upper surface of a first base plate to urge the engaging projection to the engaging recess, first finger hooking portion, whereby under a condition where the binder rings are closed, movement of both the base plates are prevented against an opening forces acting upon the binder rings. When first finger hooking portion is pushed toward second finger hooking portion, the engaging projection is disengaged from the second actuating member against the elastic force of the elastic portion, and both of the base plates are then moved in such directions as to open the binder rings.

6 Claims, 6 Drawing Sheets

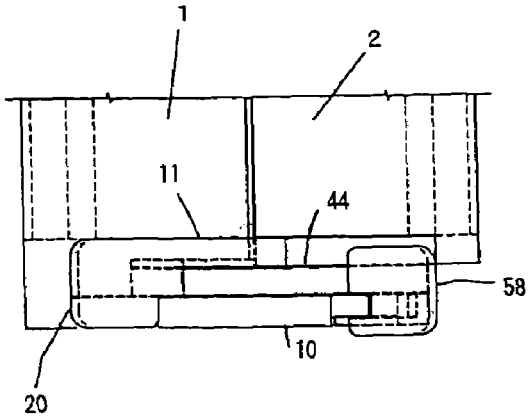
FIG. 8(b)
FIG. 8(a)
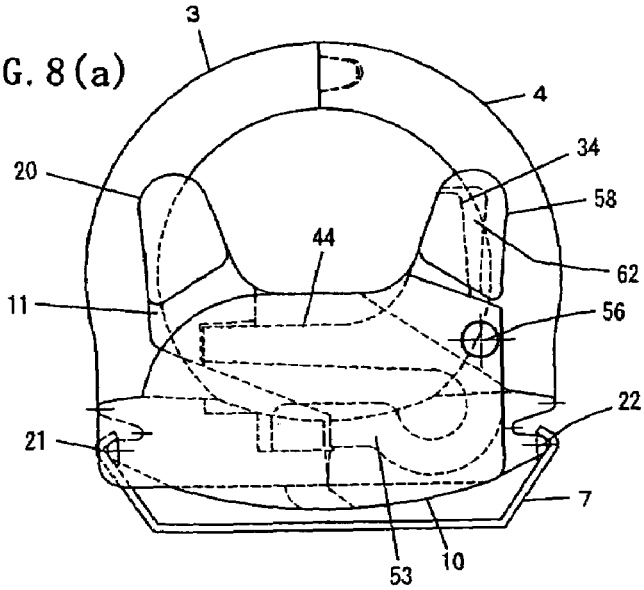
FIG. 8(c)
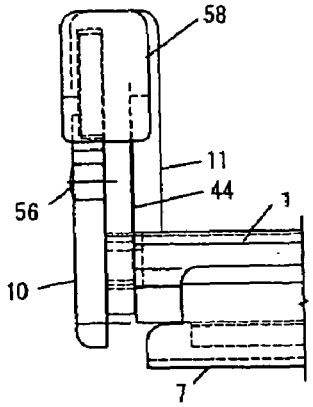
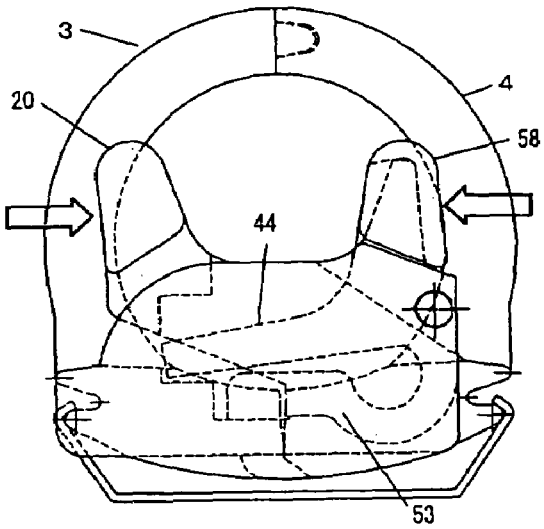
FIG. 9

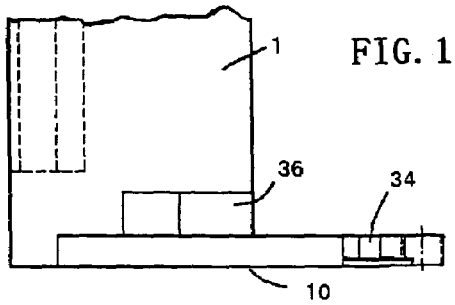
FIG. 12 (b)
FIG. 12 (a)
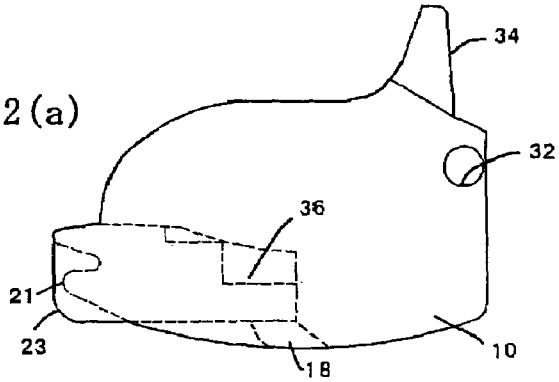
FIG. 12 (c)
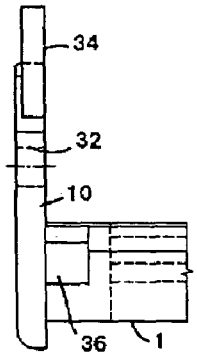
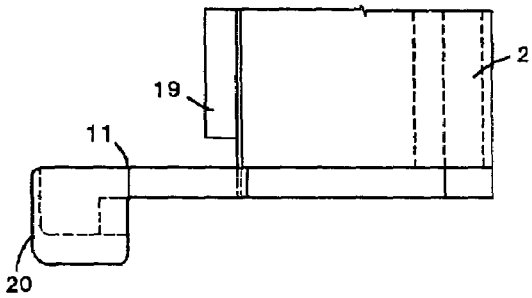
FIG. 13 (b)
FIG. 13 (c)
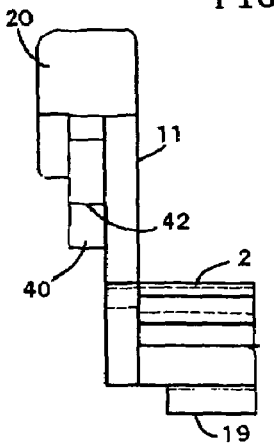
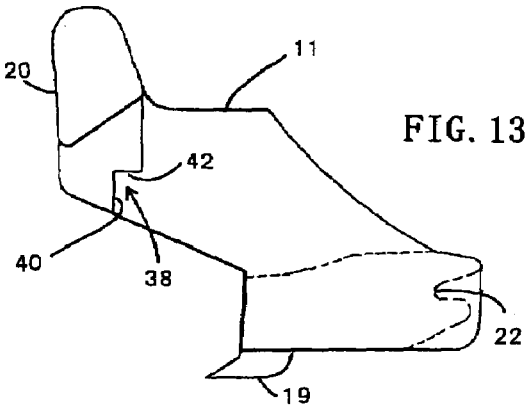
FIG. 13 (a)

FIG. 14
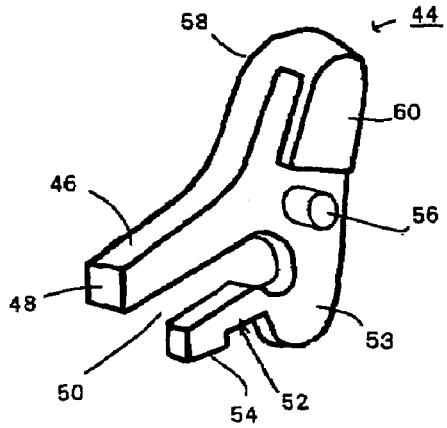
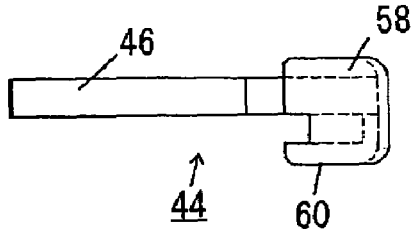
FIG. 15(b)
FIG. 15(c)
FIG. 15(a)
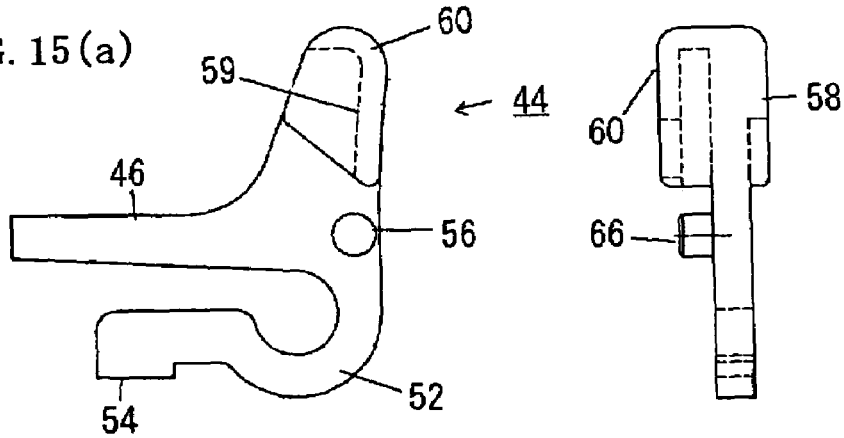

LOOSE-LEAF BINDER WITH LOCK

BACKGROUND OF THE INVENTION

1. Technical Field of the Invention

The present invention relates to a loose-leaf binder of a type in which binder rings are elastically opened and closed by actuating members, and more particularly, it relates to a loose-leaf binder with a lock to eliminate an accidental detachment of leaves owing to unintentional opening of binder rings during transportation, exhibition and storage.

2. Prior Art

Quite frequently, experienced are accidents of dislodgement of leaves of loose-leaf binders due to unintentional opening of binder rings caused by vibration or shock exerted in operation for transportation, reshipment, exhibition, storage or the like. In order to eliminate such an accident, the inventors of the present application have proposed a loose-leaf binder with locking means in Japanese Patent Publication No. 88,680/1993. Describing briefly, as shown in FIGS. 1 to 4 the disclosed loose-leaf binder includes a first and a second base plate 1 and 2 abutting against each other on their inner sides and each having a plurality of semicircular binder rings 3 and 4 adapted to abut against each other, an elastic metal sheath 7 restraining outer edges of both the base plates 1 and 2 to permit the binder rings 3 and 4 to open and close by elastic upward and downward movements of the base plates 1 and 2, and a first and a second actuating member 10 and 11 each mounted at one end of the base plate 1 and 2 to intersect each other and having a finger hooking portion 17 and 16. The first actuating member 10 fixed to the first base plate 1 includes an engaging projection 15, while the second actuating member 11 is pivotally connected to a shaft 14 at the corner of the lower end of the second base plate 2 and has an engaging portion 18' which can be engaged with and released from the engaging projection 15 by the pivotal movement of the second actuating member 11 in its locking and unlocking directions, respectively.

In the loose-leaf binder with the lock, after both the binder rings have been closed in opposite directions by fingers, the second actuating member 11 is pivotally moved from a state of FIG. 4 to a state of FIG. 1 to engage the engaging projection 15 with the engaging portion. Under this condition, there is not any risk that the binder rings unintentionally open and the leaves are dislodged therefrom owing to vibration or shock exerted in operations such as transportation, reshipment or exhibition of the loose-leaf binders in which the leaves are bound. On the other hand, when some bound leaves are replaced with others or another handling is done, the finger hooking portions 16 and 17 of both the actuating members 10 and 11 are pushed in opposite directions by fingers to move both the base plates 1 and 2 from their lower positions to their upper positions, whereby the engaging portion 18' can be disengaged from the engaging projection 15 only by a push operation with the fingers when the binder rings 3 and 4 are opened. Therefore, the above binder is excellent in operability.

OBJECT OF THE INVENTION

In the above locking mechanism, however, whenever the binder rings are closed, it is necessary that the second actuating member 11 should be pushed down by fingers to engage the engaging portion 18' on the engaging projection 15, which is troublesome.

In the above locking mechanism, moreover, there is a problem to be solved that as the second actuating member 11 can be freely pivotally moved between the states shown in FIGS. 1 and 4, the locking is likely to be unlocked in transportation or the like on being subjected to a comparatively slight external force. In order to solve this problem, it would be required to design a stronger engagement between the engaging projection 15 and the engaging portion 18'. In such an engagement, however, there would be need to push the second actuating member down by a stronger force every closing of the binder rings and to apply a stronger force to the finger hooking portions 16 and 17 every opening of the binder rings, which would also be undesirable.

Therefore, it is an object of the present invention to provide a loose-leaf binder having locking means superior in operability, which is automatically locked and unlocked for closing and opening binder rings and needs only a slight force for unlocking.

BRIEF SUMMARY OF THE INVENTION

The present invention provides a loose-leaf binder comprising a first base plate and a second base plate abutting against each other on their inner sides and each having a plurality of semicircular binder rings capable of abutting against each other, an elastic sheath for restraining outer edges of both the base plates to permit the binder rings to be opened and closed by elastic upward and downward movements of both the base plates, a second actuating member extending obliquely upwards from one end of the second base plate toward the first base plate and having at the upper end a second finger hooking portion, a first actuating member extending obliquely upwards from one end of the first base plate and intersecting the second actuating member, and a locking member interposed between the first actuating member and the second actuating member to lock the first and second actuating members when the binder rings are closed, wherein the locking member is a member integrally comprising a pivoted portion pivotally mounted in the first actuating member, an engaging projection which engages with an engaging recess of the second actuating member to prevent a movement of the second actuating member, an elastic portion which abuts against an upper surface of the first base plate to urge the engaging projection to the engaging recess, and a first finger hooking portion provided at a location opposite to the second finger hooking portion, whereby under a condition where the binder rings are closed, movements of both the base plates are prevented against an opening force acting upon the binder rings, and when both the finger hooking portions are pushed toward each other, the engaging projection is disengaged from the second actuating member against the elastic force of the elastic portion, and both the base plates are then moved in such directions as to open the binder rings.

A front elevational view of the binder of the prior art

FIG. 2

A plan view of one end of the binder of the prior art

FIG. 3

Figure 2:
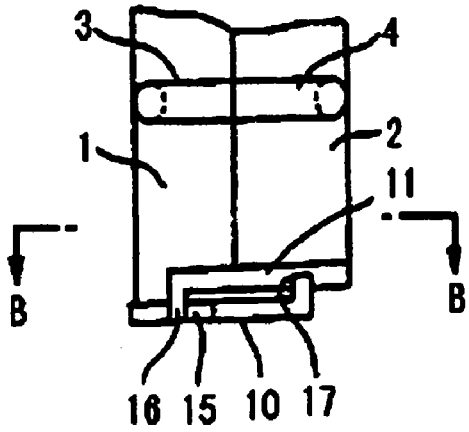
FIG. 2 PRIOR ART
Figure 3:
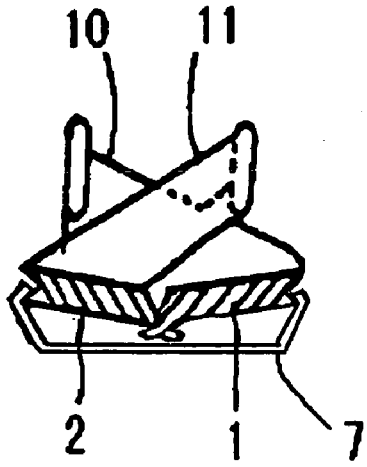
FIG. 3 PRIOR ART
Figure 4:
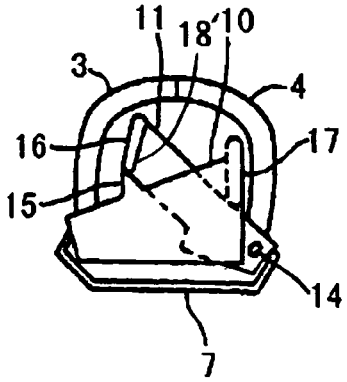
FIG. 4 PRIOR ART

A cross-sectional view of the binder taken along the line B—B in FIG. 2

FIG. 4

Figure 1:
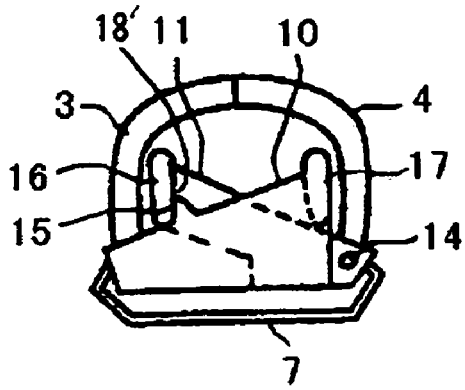
FIG. 1 PRIOR ART
FIG. 1

A front elevational view of the binder similar to FIG. 1 under an unlocked condition

FIG. 5

A plan view of the loose-leaf binder with the locking mechanism according to the invention

FIG. 6

A left side view of the loose-leaf binder with the locking mechanism according to the invention

FIG. 7

A front elevational view of the loose-leaf binder with the locking mechanism according to the invention

FIG. 8

An enlarged view of the binder with the locking mechanism according to the invention, (a) a front elevational view, (b) a plan view and (c) a right side view

FIG. 9

A view illustrating the operation for unlocking and opening the binder rings of the binder with the locking mechanism according to the invention

FIG. 10

A view illustrating the unlocking operation of the locking mechanism according to the invention following to the step shown in FIG. 9

FIG. 11

A view illustrating an opened condition of the binder rings of the locking mechanism according to the invention

FIG. 12

A view illustrating the first base plate provided with part of the locking mechanism according to the invention, (a) a front elevational view, (b) a plan view and (c) a right side view

FIG. 13

A view illustrating the second base plate provided with another part of the locking mechanism according to the invention, (a) a front elevational view, (b) a plan view and (c) a right side view

FIG. 14

A perspective view of the locking member according to the invention

FIG. 15

A view illustrating the structure of the locking member according to the invention, (a) a front elevational view, (b) a plan view and (c) a right side view

DETAILED EXPLANATION OF THE INVENTION

In a preferable embodiment of the present invention, the engaging recess of the second actuating member comprises a first surface provided at a location for preventing the movement of the second actuating member, and a second surface on which the engaging projection engages under the influence of the elastic portion, whereby under a condition where the binder rings are closed, the forward end of the engaging projection engages with the first surface to prevent the movement of the first actuating member against an external force in a direction to open the binder rings, and when both the actuating members are pushed in opposite directions, the engaging projection is pivotally moved about the pivoted portion to be disengaged from the engaging recess.

In another preferable embodiment of the present invention, the engaging projection and the elastic portion extend substantially parallel to each other from the pivoted portion.

In still another preferable embodiment of the present invention, the elastic portion has an arcuate proximal end separated from the engaging projection.

EFFECTS OF THE INVENTION

The locking member for binder rings above described according to the invention is a member integrally comprising a pivoted portion pivotally mounted in the first actuating member, an engaging projection which engages with an engaging recess of the second actuating member to prevent a movement of the second actuating member, an elastic portion abutting against an upper surface of the first base plate to urge the engaging projection to the engaging recess, and a first finger hooking portion provided at a location opposite to the second finger hooking portion. The pivoted portion of the locking member is pivotally mounted on a shaft provided on the inner surface of the first actuating member. As an alternative, the pivoted portion may be formed by a shaft which may be pivoted in a shaft hole formed in the first actuating member.

According to this construction, when the binder rings which are in an opening state are pushed in opposite directions by fingers, the first and second base plates are elastically moved downwards about their outer edges supported by the elastic sheath, whereby the right and left binder rings abut against each other and they are hence closed, while the engaging projection of the locking member becomes aligned with and below the engaging recess of the first actuating member so as to be fitted in the engaging recess with the aid of the elastic force of the elastic portion, thereby achieving the automatic locking. As the engaging projection is elastically biased described above, no unlocking occurs even if being subjected to any shock during transportation or the like.

Under the closed state of the binder rings, the locking condition is maintained by the engaging projection resisting at the wall surface of the engaging recess to an external force exerting in the direction for opening the binder rings.

In order to open the binder rings which is in a closing state, both the finger hooking portions are pushed in opposite directions, whereby the engaging projection is disengaged from the engaging recess of the second actuating member against the elastic force of the elastic portion. Then, both the finger hooking portions are continuously pushed, whereby the first and second actuating members are pushed in opposite directions, so that both the base plates are upwards pushed to elastically move to upward positions, thereby opening the binder rings.

It is very convenient that the locking and unlocking are automatically effected in accordance with the normal opening and closing operations in this manner.

BEST MODE FOR CARRYING OUT THE INVENTION

Preferably, the engaging recess of the second actuating member comprises a first surface provided at a position for preventing the movement of the second actuating member and a second surface on which the engaging projection engages under the influence of the elastic portion, whereby under a condition that the binder rings are closed, the forward end of the engaging projection engages with the first surface to prevent the movement of the first actuating member against an external force in a direction to open the binder rings, and when both the actuating members are pushed in opposite directions, the engaging projection is pivotally moved about the pivoted portion to be disengaged from the engaging recess.

In consequence, even if the opening action is exerted on the binder rings under their closed condition (for example, in a case that an external force is applied to the weight of the bound leaves of the binder), the movement of the first surface is prevented by its abutment against the engaging projection, whereby a locking state is maintained. During which the engaging projection serves to maintain the locking condition because the engaging projection elastically contacts the second surface to be anchored by it.

On the other hand, in a case where the binder rings are opened, both the finger hooking portions are pushed in opposite directions, whereby the engaging projection is pivotally moved against the elastic force about the pivoted portion to separate from the second surface and moves to a lower position where it does not contact the first surface. As understood from the above, this constitution permits easily performing the locking and unlocking.

In a constitution in which the engaging projection and the elastic portion extend substantially parallel to each other from the pivoted portion, the elastic force is applied at right angles to the extending direction of the engaging projection, whereby the required elastic action above described can be obtained. Moreover, the elastic portion has an arcuate proximal end which swells in a direction away from the engaging projection, whereby the portion forming the elastic portion is elongated to distribute exerted stresses over a wide range, resulting in a prolongation of the lifetime of the locking member.

EMBODIMENT

One embodiment of the invention will be explained with reference to the drawings in detail hereinafter. Members in the embodiment corresponding to those of the prior art shown in FIGS. 1 to 4 are designated by the same reference numerals for easy understanding of the invention.

Figure 5:
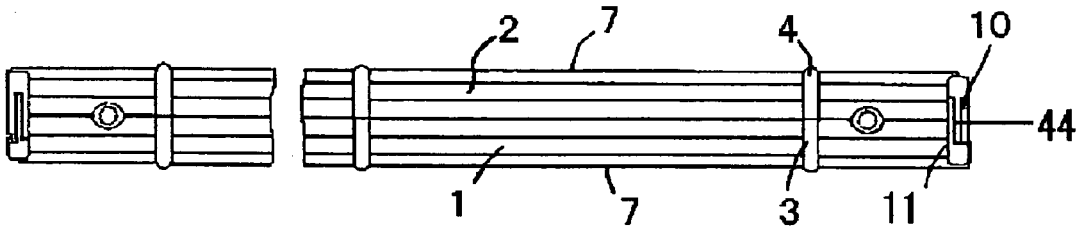
Figure 6:
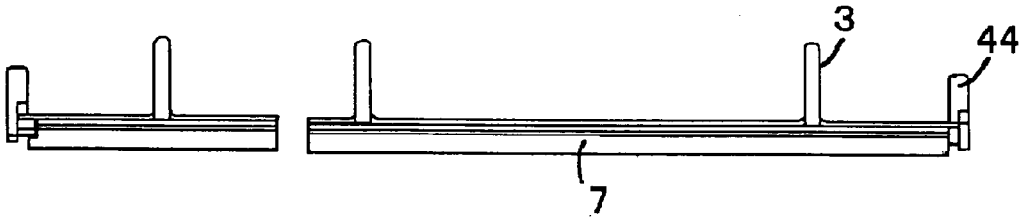
Figure 7:
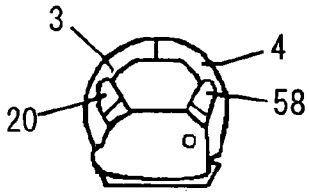

FIG. 5 is a plan view of a loose-leaf binder with a locking member according to the invention. FIGS. 6 and 7 are left and right side views of the loose-leaf binder shown in FIG. 5, respectively.

Figure 11:
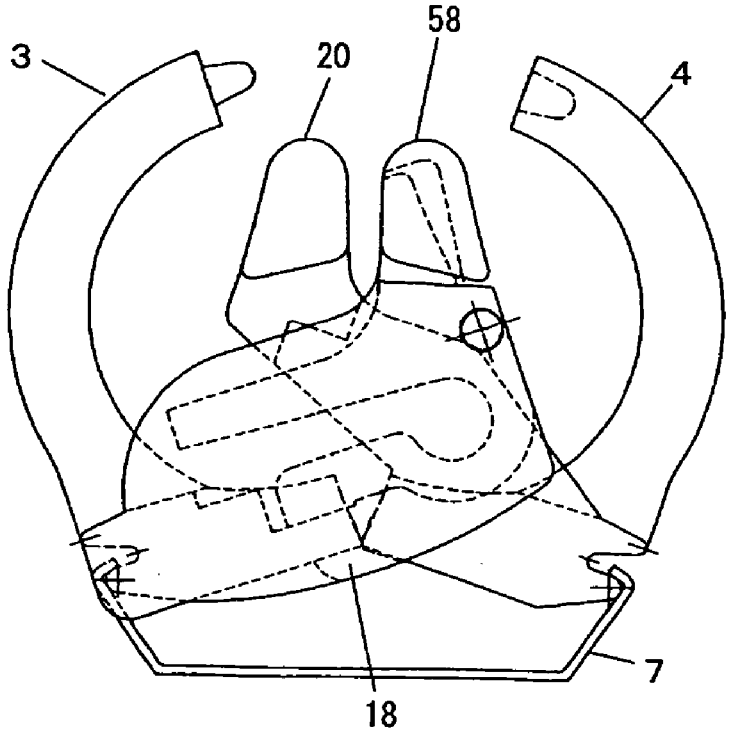

FIGS. 8 and 11 are enlarged front elevations of one end of the loose-leaf binder with the locking member under a closed and an opened condition, respectively.

A first and a second elongated base plate 1 and 2 abutting against each other on their inner sides each have a plurality of semicircular binder rings 3 and 4 formed integrally therewith. On both outer edges 21 and 22 of both the base plates 1 and 2 (FIG. 8(*a*)), an elastic sheath 7 is provided which restrains the outer edges and allows the binder rings 3 and 4 to be opened and closed by elastic upward and downward movements of the base plates 1 and 2. The downward movements of the base plates 1 and 2 are limited by an abutment of the binder rings 3 and 4 against each other, which is the closed state of the binder rings 3 and 4 as shown in FIG. 8(*a*). The upward movements of the base plates 1 and 2 about their outer edges as pivot shafts are limited by a plurality of stopper members 18 and 19 provided alternately on bottom surfaces of the base plates 1 and 2 along inner abutment edges of their bottoms as shown in FIGS. 11, 12(*a*) and 13(*a*), which is the opened state of the binder rings 3 and 4.

The first and second base plates 1 and 2 are provided at both ends with first and second actuating members 10 and 11 fixed thereat by integral formation, respectively, which extend at right angles to longitudinal directions (axial directions) of the first and second base plates 1 and 2 and intersecting each other. Further, the base plates are each formed along the outer edge with a ridge 21 and 22 on which the elastic sheath is fitted and assembled as shown in FIG. 8(*a*).

A locking mechanism according to the invention will be explained herein with reference to FIGS. 8 to 15. A locking member may be provided only at one end of the binder, or locking members may be provided one at each end of the binder and since they have a similar or symmetrical structure, the locking member at one end only will be explained.

Figure 10:
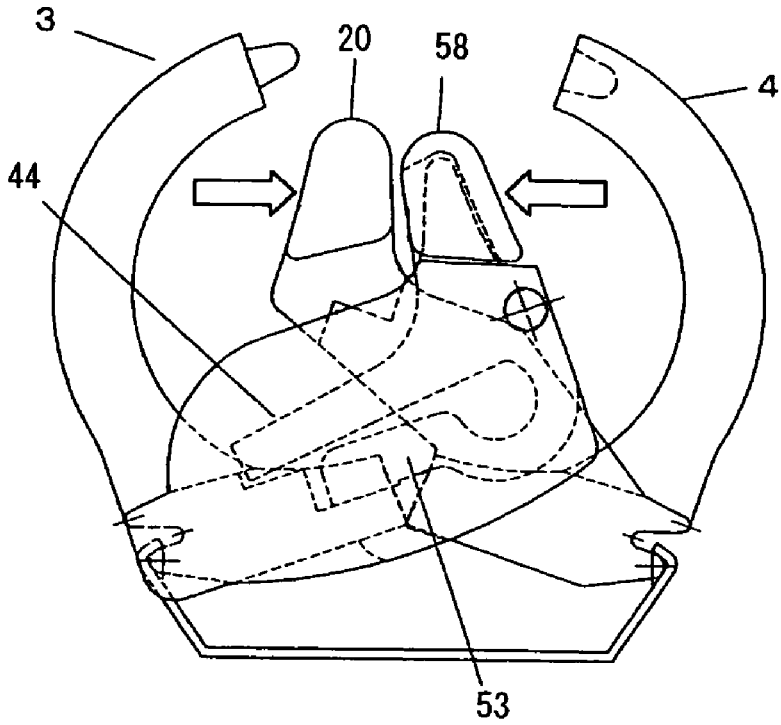

FIGS. 8 to 11 illustrate the binder with the locking mechanism according to the invention among which FIGS. 9 and 10 are views for explaining the consecutive operations of the mechanism.

FIG. 12 illustrates the structure of the one end of the first base plate provided with part of the locking mechanism, and (a) is a front view, (b) a plan view and (c) a right side view, respectively.

FIG. 13 illustrates the structure of the one end of the second base plate provided with another part of the locking mechanism, and (a) is a front view, (b) a plan view and (c) a right side view, respectively.

FIG. 14 is a perspective view of the locking member.

FIG. 15 illustrates the structure of the locking member, and (a) is a front view, (b) a plan view and (c) a right side view, respectively.

Referring to FIG. 8, arranged between the first and second actuating members 10 and 11 is the locking member 44 having the subject features of the present invention. The first actuating member 10 is formed at its upper end with an actuating protrusion 34, and the second actuating member 11 forms at its upper end a finger hooking portion 20. The locking member 44 forms a finger hooking portion 58 at upper outside portion. The first and second actuating members 10 and 11 are closely arranged to be shifted in the longitudinal direction of the base plates 1 and 2 to form a clearance therebetween in which the locking member 44 is arranged.

When the finger hooking portions 20 and 58 are pushed in opposite directions, the second locking member 11 is first unlocked as described later. Next, when they are further pushed, the actuating protrusion 34 is also pushed by the finger hooking portion 58, whereby the first and second base plates 1 and 2 are elastically upwards moved to open the binder rings 3 and 4. Reversely, when the right and left binder rings are pushed in opposite directions by fingers, the base plates 1 and 2 are moved downwards to bind leaves, at which instant the second actuating member 11 is automatically locked. Such an operation will be explained in detail later.

Structure of Portions of the First Actuating Member

Explaining the portions associated with the locking mechanism for the first actuating member 10 with reference to FIG. 12, the first actuating member 10 is formed with a shaft hole 32 in the proximity of the right hand edge viewed in FIG. 12(*a*) for receiving the shaft 56 of locking member 44. Further, the first actuating member 10 is provided at its upper end with an actuating protrusion 34 to which a force of the finger is applied through the finger hooking portion 58 of the locking member 44. Adjacent the first actuating member 10, the first base plate 1 is formed with holding surface 36 against which the abutment portion 54 of an elastic portion of the locking member 44 abuts.

Structure of Portions of the Second Actuating Member

Explaining the portions associated with the locking mechanism for the second actuating member 11 with reference to FIG. 13, the second actuating member 11 includes an engaging recess 38 having a first surface 40 and a second surface 42. The first surface 40 is adapted to anchor the forward end of an engaging projection 46 of the locking member 44 to prevent the binder rings from opening, while the second surface 42 is adapted to contact the side surface of the engaging projection 46 biased by an elastic portion 52 to maintain the locked condition.

Structure of the Locking Member

The structure of the locking member will be explained with reference to FIGS. 14 and 15. The locking member 44 includes a shaft 56 adapted to be fitted in the shaft hole 32 provided in the first actuating member 10 and is able to pivotally move about the shaft 56. The locking member 44 is substantially a plate-shaped member integrally formed of a strong synthetic resin or the like. (As an alternative, instead of the shaft 56, the locking member 44 may be formed with a shaft hole, while the first actuating member 10 may be provided with a corresponding shaft to be fitted in the shaft hole.)

The locking member 44 integrally includes the engaging projection 46 adapted to anchor the first surface 40 of the engaging recess 38 of the second actuating member 11 to prevent its movement, the elastic portion 52 having the abutment portion 54 adapted to abut against the holding surface 36 provided on the upper surface of the first actuating member 10 of the first base plate 1 to urge the engaging projection 46 to the engaging recess 38, and the first finger hooking portion 58 located at a position opposite to the second finger hooking portion 20. The locking member 44 may be provided at the finger hooking portion 58 with a cover portion 60 for covering the actuating protrusion 34 provided on the first actuating member 10. Between an inner wall 59 of the cover portion 60 and the actuating protrusion 34 (its edge on the right side viewed in FIG. 8(*a*)), a clearance 62 is provided, and the finger hooking portions 20 and 58 are pushed in opposite directions to disengage the engaging projection 46 from the engaging recess 38, whereby the inner wall of the cover portion 60 engages with the actuating protrusion 34 to transmit the movement of the finger hooking portion 58 to the first actuating member 10, thereby opening the binder rings. Without using the above procedure, such an unlocking is also possible. In this case, however, the elastic portion 52 of the locking member 44 may be deformed to an excessive extent, resulting in a reduction in effective service life.

An undesirable force unintentionally opening the binder rings arising from the binder or the like may be applied to the engaging end 48 of the engaging projection 46 through the engaging recess 38 of the second actuating member 11. However, the force applied to the engaging projection 46 acts substantially at right angles to the fixed shaft 56, so that the second actuating member 11 cannot be moved and hence the locking is maintained.

The upper surface of the forward end of the engaging projection 46 is always urged upwards by the elastic portion 52 to be brought into contact with the opposite wall surface of the engaging recess 38. The engaging projection 46 and the elastic portion 52 are arranged substantially parallel to each other, interposing a slot 50 therebetween. In order to avoid any stress concentration at the elastic portion 52 for prolongation of life time, the elastic portion 52 is provided with an arcuate proximal end 53 having a large radius of curvature.

The embodiment will be explained in further detail with reference to FIGS. 8 and 11 illustrating the end of the binder incorporating the locking member 44 and FIGS. 9 and 10 illustrating the operating conditions of the locking mechanism according to the invention.

In FIG. 8 showing the closed condition of the binder rings, the shaft 56 of the locking member 44 is fitted in the shaft hole 32 of the first actuating member 10, and the forward end of the engaging projection 46 engages with the engaging recess 38 of the second actuating member 11. The abutment portion 54 of the elastic portion 52 abuts against the holding surface 36 formed on the first actuating member 10 of the base plate 1 to maintain the engaging projection 46 in the engaging recess 38 with the aid of the elastic force of the elastic portion 52. Under this condition, even if an external force is applied in a direction to open the binder rings 3 and 4, the locking will be maintained without a disengagement of the engaging projection 46 of the locking member 44 from the engaging recess 38 of the second actuating member 11, whereby dislodgement of the leaves from the loose-leaf binder can be prevented.

When it is desired to open the right and left binder rings 3 and 4, the finger hooking portions 20 and 58 are merely pushed in opposite directions. In consequence, the engaging projection 46 is pivotally moved about the shaft 56 against the elastic force of the elastic portion 52 to disengage from the engaging recess 38 as shown in FIG. 9. At this time, the finger hooking portion 58 engages with the actuating protrusion 34 of the first actuating member 10. The push operation is continued, whereby both the base plates 1 and 2 begin to move upwards through the first and second actuating members 10 and 11 and are finally moved upwards elastically with the aid of the elasticity of the elastic sheath 7 to open the binder rings 3 and 4. The state is shown in FIGS. 10 and 11.

Reversely, when the binder rings 3 and 4 are pushed in opposite directions in FIG. 11, the base plates 1 and 2 are spontaneously returned from the state shown in FIG. 11 to the state in FIG. 8 by the biasing force constantly applied by the elastic portion 52, thereby automatically achieving the locking condition.

As can be seen from the above description, in the loose-leaf binder according to the invention, on closing the binder rings from the open state to the closed state the locking is automatically effected to preclude the opening of the binder rings due to an undesirable external force acting upon the binder rings, while when the finger hooking portions are actuated to open the binder rings, the locking can be readily unlocked to open the binder rings with ease.

The invention claimed is:

1. A loose-leaf binder comprising a first base plate and a second base plate abutting against each other on their inner sides and each having a plurality of semicircular binder rings capable of abutting against each other, an elastic sheath for restraining outer edges of both the base plates to permit the binder rings to be opened and closed by elastic upward and downward movements of both the base plates, a second actuating member extending obliquely upwards from one end of the second base plate toward the first base plate and having at the upper end a second finger hooking portion, a first actuating member extending obliquely upwards from one end of the first base plate and intersecting the second actuating member, and a locking member interposed between the first actuating member and the second actuating member to lock the first and second actuating members when the binder rings are closed, wherein the locking member is a member integrally comprising a pivoted portion pivotally mounted in the first actuating member (10), an engaging projection which engages with an engaging recess of the second actuating member to prevent a movement of the second actuating member, an elastic portion which abuts against an upper surface of the first base plate to urge the engaging projection to the engaging recess, and a first finger hooking portion provided at a location opposite to a second finger hooking portion, whereby under a condition where the binder rings are closed, movements of both the base plates are prevented against an opening force acting upon the binder rings, and when both the finger hooking portions are pushed toward each other, the engaging projection is disengaged from the second actuating member against the elastic force of the elastic portion, and both the base plates are then moved in such directions as to open the binder rings.

2. The loose-leaf binder according to claim 1, wherein the engaging recess of the second actuating member comprises a first surface provided at a location for preventing the movement of the second actuating member, and a second surface on which the engaging projection engages under the influence of the elastic portion, whereby under a condition where the binder rings are closed, the forward end of the engaging projection engages with the first surface to prevent the movement of the first actuating member against an external force in a direction to open the binder rings, and when both the actuating members are pushed in opposite directions, the engaging projection is pivotally moved about the pivoted portion to be disengaged from the engaging recess.

3. The loose-leaf binder according to claim 1, wherein the engaging projection and the elastic portion extend substantially parallel to each other from the pivoted portion.

4. The loose-leaf binder according to claim 3, wherein the elastic portion has an arcuate proximal end.

5. The loose-leaf binder according to claim 2, wherein the engaging projection and the elastic portion extend substantially parallel to each other from the pivoted portion.

6. The loose-leaf binder according to claim 5, wherein the elastic portion has an arcuate proximal end.

* * * * *